United States Patent [19]

Klee

[11] Patent Number: 4,726,195

[45] Date of Patent: Feb. 23, 1988

[54] CRYOGENIC FORCED CONVECTION REFRIGERATING SYSTEM

[75] Inventor: David J. Klee, Emmaus, Pa.

[73] Assignee: Air Products and Chemicals, Inc., Allentown, Pa.

[21] Appl. No.: 899,448

[22] Filed: Aug. 22, 1986

[51] Int. Cl.[4] ..... F25D 25/00

[52] U.S. Cl. ..... 62/62; 62/52; 62/388

[58] Field of Search ..... 62/52, 388, 62, 380

[56] References Cited

U.S. PATENT DOCUMENTS

| | | | |
|---|---|---|---|
| 2,447,249 | 8/1948 | Hill | 62/63 |
| 3,063,258 | 11/1962 | Szachnitowski | 62/309 |
| 3,733,848 | 5/1973 | Duron et al. | 62/381 |
| 3,868,827 | 3/1975 | Linhardt et al. | 62/63 |
| 4,033,140 | 7/1977 | Klee et al. | 62/223 |
| 4,058,384 | 11/1977 | Keefe | 62/457 |
| 4,090,369 | 5/1978 | Le Diouron | 62/380 |
| 4,229,947 | 10/1980 | Klee | 62/374 |
| 4,315,409 | 2/1982 | Prentice | 62/63 |
| 4,373,344 | 2/1983 | Hinn | 62/388 |
| 4,399,658 | 8/1983 | Nielson | 62/514 R |
| 4,475,351 | 10/1984 | Klee | 62/63 |
| 4,481,780 | 11/1984 | Delano | 62/52 |
| 4,524,548 | 6/1985 | Klee et al. | 51/322 |
| 4,589,264 | 5/1986 | Astrom | 62/380 |

*Primary Examiner*—Ronald C. Capossela

*Attorney, Agent, or Firm*—Geoffrey L. Chase; James C. Simmons; William F. Marsh

[57] ABSTRACT

A process and apparatus are set forth for a refrigerating or freezing system wherein liquid cryogen, such as liquid air, is fully vaporized during use to avoid dangers of liquid cryogen pooling, liquid cryogen contact with apparatus surfaces or inadvertent oxygen enrichment.

6 Claims, 2 Drawing Figures

CRYOGENIC FORCED CONVECTION REFRIGERATING SYSTEM

TECHNICAL FIELD

The present invention is directed to a refrigeration or freezing system whereby products, such as foodstuffs, are contacted with a cryogenically chilled cooling medium to refrigerate or freeze the product. More specifically, the invention is directed to such a refrigeration or freezing system whereby no liquid cryogen contacts the product to be refrigerated or frozen, contacts apparatus surfaces or collects on horizontal surfaces of the system's apparatus.

BACKGROUND OF THE PRIOR ART

Various processes and apparatus are known in the prior art for refrigerating or freezing products, including hardware and foodstuffs. Many of these systems utilize liquid cryogen-chilled refrigerating gas. Typically, the prior art systems attempt to vaporize the liquid cryogen substantially before contact with the product to be refrigerated or frozen, but in many instances the cryogen does not become a fully vaporized and, in fact, collects, pools or settles on various horizontal surfaces in these known prior art refrigerating or freezing systems.

Exemplary of such a prior art cryogenic freezer is the freezer disclosed in U.S. Pat. No. 4,475,351, wherein a cryogenic liquid refrigerant is sprayed into one or more of the cooling zones in the central region of the tunnel comprising the freezing in an upward direction into the rotating fans of the freezer to thus vaporize the refrigerant before it flows downwardly into contact with conveyed products passing through the freezer. The suggested liquid cryogen is liquefied nitrogen. Other cryogenic liquids such as liquid carbon dioxide, liquid air and refrigerants having normal boiling points substantially below −50° F. (−46° C.) can be used. The system is designed to utilize cryogen in a manner so that it does not directly contact the food product in its liquid state in order to avoid thermal shock if the product was directly exposed to the cryogen spray. However, merely directing the liquid cryogen into the recirculating fan does not insure that essentially all liquid cryogen is evaporated prior to contacting the product or horizontal surfaces where the cryogen might pool.

U.S. Pat. No. 4,481,780 discloses a process and apparatus for the generation of a cold gas by mixing a liquid cryogen and a relatively warm gas together in a double T-shaped conduit apparatus whereby when the warm gas and the cryogen are mixed, total vaporization of the cryogen occurs without pressure fluctuations or pulsations in the mixing area. The system requires a reservoir or dead-end 6 in order to ensure that cryogen is fully vaporized before leaving through the outlet 8. The drawback of this system is that it requires a discrete premixing zone prior to the utilization of the chilled coolant gas.

U.S. Pat. No. 4,524,548 discloses a product cooling apparatus for deflashing molded products by embrittleing the flashing of the products and blasting it with solid particulate material. This system also attempts to avoid contact of liquid cryogen and the product being deflashed in order to preclude thermal shock to the deflashing product. Liquid cryoen evaporation is achieved in part by locating the liquid cryogen entry sufficiently away from the product site and in a dispersal direction sufficiently away from the product so that the cryogen only contacts the product after circuitous entry into the product chilling zone. The cryogen is assisted in its evaporation by co-mingling with particulate material that is thrown against the product to remove embrittled flashing.

Other patents directed to refrigeration, refrigeration with cold air and refrigeration with liquid air, as well as freezing processes and apparatus, include U.S. Pat. Nos. 2,447,249; 3,733,848; 3,868,827; 4,033,140; 4,229,947 and 4,315,409.

The drawbacks of the prior art in refrigerating and freezing of products and foodstuffs, particularly using liquid cryogen, such as liquid air, which presents special problems in addition to the thermal shock effect of known prior art liquid cryogens are overcome by the present invention as described below.

BRIEF SUMMARY OF THE INVENTION

The present invention is directed to a method of refrigerating products by contact with a refrigerating gas which comprises introducing product into a refrigeration zone, contacting the product with the refrigerating gas for a sufficient time to refrigerate it to the appropriate extent and removing the refrigerated product, the improvement for producing the refrigerating gas from a liquid cryogen such that all of the liquid cryogen is fully vaporized before contacting the product comprising; introducing the liquid cryogen at elevated pressure into an ejector as the motive fluid to accelerate a portion of a warm refrigerating gas through the ejector while mixing the cryogen and gas to effect complete vaporization of the liquid cryogen and substantial cooling of said portion of the refrigerating gas resulting in a cold discharge gas which is above the liquefaction temperature of the cryogen; introducing the cold discharge gas into a forced circulation pathway of refrigerating gas and producing a cold refrigerating gas which contacts and refrigerates product and is then at least partially recirculated; and sensing the temperature of the refrigerating gas in the forced circulation pathway and controlling the introduction of liquid cryogen with regard to the sensed temperature to maintain a prescribed temperature in the refrigeration zone above the liquefaction temperature of the cryogen utilized.

The present invention is further directed to a refrigerating apparatus for refrigerating product comprising an insulated refrigeration compartment, a recirculation fan for producing a forced circulation pathway of refrigerating gas, a temperature sensor for determining the temperature of the refrigerating gas, an ejector for mixing refrigerating gas with liquid cryogen, means for introducing liquid cryogen into said ejector, and control means for varying the input of liquid cryogen according to the temperature sensed by the temperature sensor so that no liquid cryogen contacts the product to be refrigerated.

Preferably, the process is controlled and the apparatus is configured such that the mass flow of the portion of the warm refrigerating gas is equal to the mass flow of the liquid cryogen times the difference in the enthalpy of the cooled portion of the refrigerating gas discharging from the ejector (discharge gas) from the enthalpy of the liquid cryogen divided by the difference of the enthalpy of the portion of the warm refrigerating gas (return gas) from the enthalpy of the cooled portion of the refrigerating gas discharging from the ejector (discharge gas).

DETAILED DESCRIPTION OF THE INVENTION

Figure 1:
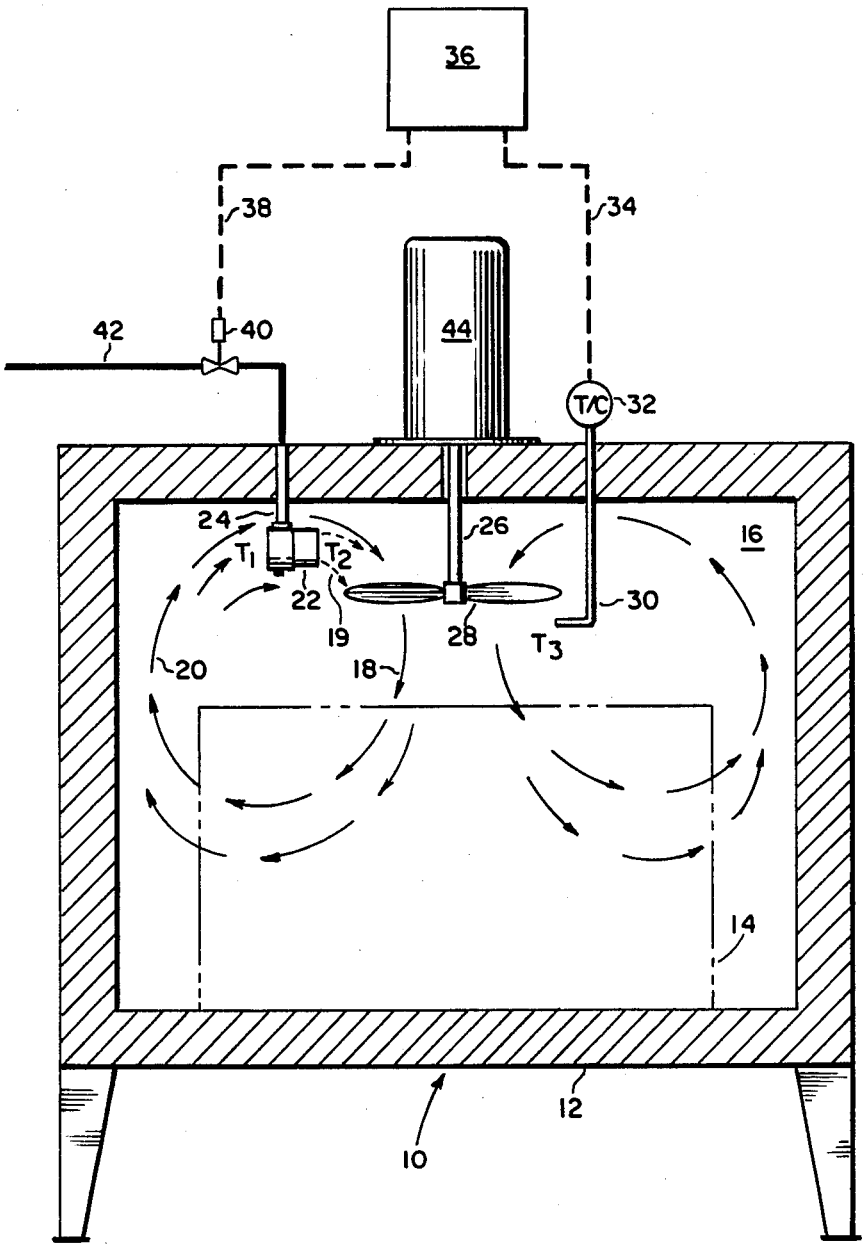
FIG. 1 represents a cross-sectional view of a cryogenic refrigeration/freezing apparatus showing the cryogen vaporization system.

The present invention is directed to a process and apparatus for ensuring that essentially all liquid cryogen utilized in a refrigerating or freezing process or apparatus is essentially completely vaporized prior to contacting interior surfaces of the refrigeration or freezing apparatus where the cryogen may have the opportunity to pool or collect, and in order to avoid contact of liquid cryogen with product or foodstuff being processed in the refrigeration/freezing process and/or apparatus. The term refrigeration will be understood to include cooling to the extent of freezing wherein any water content of product being cooled is in the solid state.

In the past, various refrigeration and freezing systems have been known which attempt to vaporize substantial amounts of liquid cryogen, but in no way ensure complete vaporization. Other systems have been devised where remote vaporization of the cryogen fails to provide its full refrigerating value to the product being processed in the refrigeration or freezing apparatus.

The present invention overcomes the problems of the prior art by providing a process and means for ensuring essentially all liquid cryogen is vaporized into the cold refrigerating gas of the refrigeration/freezing apparatus prior to contact of the cryogen in its mixture with the gas against; (a) the product being cooled or chilled, (b) any substantial horizontal surfaces or (c) other interior surface of the apparatus where the extremely low temperature of the cryogen may induce structural problems. The criticality of this achievement is realized; (a) in the potential for liquid cryogen contacting combustible material wherein the liquid cryogen provides a source of enriched oxygen, such as liquid air, (b) in the danger of human contact with liquid cryogen, and (c) the potential for damage to the apparatus due to effects of temperature extremes experienced by contact of liquid cryogen on apparatus surfaces not intended for such contact.

With regard to the first criticality, where the liquid cryogen may contain oxygen, such as in the use of liquefied air, the opportunity for nitrogen, being more volatile, to differentially evaporate away from any liquid air, leaving an enriched liquid oxygen concentration, poses a detonation problem when the liquid air, enriched in oxygen, comes in contact with a combustible source, such as hydrocarbons and foodstuffs in general, when in the presence of an ignition source. For instance, it has been known for fatty food material to achieve a state of detonation when liquid air, enriched in oxygen due to the differential evaporation of nitrogen from the liquid air, contacts the fatty food material in the presence of an ignition source, particularly when a high fat content is present. Accordingly, when using an oxygen-containing cryogen such as liquid air, a danger exists because of the differential vaporization of nitrogen at a higher rate than oxygen to incur an oxygen-enriched atmosphere which may come in contact with combustible material and create a rapid oxidation or energy release situation wherein detonation, combustion or explosion is possible. By ensuring that full vaporization of not only the nitrogen, but the more slowly evaporating oxygen, is achieved prior to contact with oxidizable sources, such as products to be frozen or foodstuffs, the opportunity for a highly oxygen-enriched atmosphere to exist near such oxidizable sources, is eliminated.

In addition, cryogenic refrigerators and freezers have been widely used in the food industry and other industries wherein operators periodically are required to open the freezers for inspection and cleaning purposes. This is aggravated in the food freezing industry where inspections are required on a more frequent basis. Operator contact of any pooled cryogen has severe results on the point of contact of the operator. Liquid cryogen quickly burns exposed tissue in an irreparable manner similar to burns sustained by high temperature materials. Accordingly, it is important, particularly in freezing aparatus requiring frequent entry in cleaning, such as in the food industry, that liquid cryogen, whether it be inert or oxygen-containing, be fully vaporized so that it does not have the opportunity to pool and collect on surfaces that may be contacted by service or operator personnel.

Finally, contact of liquid cryogen against the interior walls of the refrigerator/freezer may chill and liquefy air contained in the wall causing a vacuum and pulling additional air into the wall structure. When liquid cryogen ceases to contact the wall by changed operation or shutdown, the wall warms up, the liquid air evaporates and the resulting pressurized air can deform or stress the apparatus.

The present invention avoids these problems while still maintaining the efficiency required by utilizing liquid cryogen closely and directly with the product to be frozen.

The refrigerating/freezing systems of the present invention may be a batch system requiring introduction of a single or group of products for a unit cycle time of refrigeration or freezing or the system may utilize a continuous freezer as is shown in some of the prior art, whereby an elongated refrigeration/freezing tunnel is implemented with a conveyor belt whereby the product is slowly passed through the refrigeration/freezing system for cooling and optional freezing prior to exit from the system for further processing. The present invention may also utilize a series of liquid cryogen-refrigeration gas mixers in contact zones within a single system. The cryogenic refrigeration/freezer is an insulated chamber, either batch-type or continuous, having a means of circulation of refrigeration or freezing gas within the chamber whereby one or more recirculating fans provide sufficient gas velocity to produce forced convection, cooling and potential freezing of product or foodstuff present in the chamber. The recirculating fans can be centrifugal, axial flow or radial flow, depending on the specific refrigeration/freezing equipment requirements. A cryogen-gas mixer is positioned within the chamber and is directed toward the inlet of the recirculating fan. A temperature sensing probe, such as a thermocouple, is placed in the gas stream leaving the recirculating fan. The temperature sensing probe is connected to a temperature controller or micro-computer. The temperature controller actuates an on/off valve in the cryogen supply line. When the controlled gas temperature is warmer than the setpoint of the temperature controller, the on/off valve is opened to admit the cryogen into the freezer. This system will now be described in greater detail with reference to the drawings.

With reference to FIG. 1, a refrigeration freezing apparatus 10 is shown in cross-section comprising an insulated wall 12 creating a chamber 16 wherein a product 14 is either positioned or conveyed depending on whether a batch or continuous system is desired. A refrigerating gas is shown circulating in chamber 16 by means of a recirculation fan 28 attached to rotating shaft 26 driven by an electric motor 44. The fan 28 propels cold refrigerating gas 18 toward the product 14 where it cools the product 14 and returns slightly warmer as warm refrigerating gas 20. At least a portion of the warm refrigerating gas 20 passes through an ejector 22 and, if temperature conditions are appropriate, is mixed with liquid cryogen supplied through line 24, whereby the liquid cryogen at elevated pressure accelerates the portion of the warm refrigerating gas through the ejector creating high turbulence and efficient mixing, such that the liquid cryogen is fully vaporized in the portion of the refrigerating gas because of the turbulence and mixing and because of the controlled ratio of liquid cryogen introduced into the flow of the portion of the refrigerating gas, so that the liquid cryogen is fully vaporized as it leaves the ejector as flow 19 which comingles with the remainder of the warm refrigerating gas 20, whereby the combined gas is at an intermediate cool temperature as cold refrigerating gas 18. The cold refrigeration gas 18 leaving the fan 28, in a forced circulation pathway, is temperature sensed by thermocouple 30 to control the overall refrigeration/freezing chamber to avoid temperatures so cold as to prevent total liquid cryogen vaporization, while at the same time avoiding temperatures so warm as to render the chilling of the product 14 inefficient or incomplete. The temperature sensing is converted to an electrical signal in the control thermocouple 32 and it is passed through line 34 to a temperature controller 36 which is a time-proportional controller, which compares the sensed temperature against programmed temperature parameters and provides an output signal through line 38 to a solenoid valve 40 to actuate liquid cryogen delivery through line 42 to the ejector 22. Appropriately, when the temperature sensing is below the calibrated temperature, the valve will be closed, while if the temperature is above the calibrated temperature, the valve will be open to admit liquid cryogen. Preferably the valve is either fully on or fully off because cryogen line pressure is important to adequate vaporization in the ejector. The cold refrigerating gas 18 cools the product 14 and is rewarmed wherein it is then at least partially recirculated as warm refrigerating gas 20.

Figure 2:
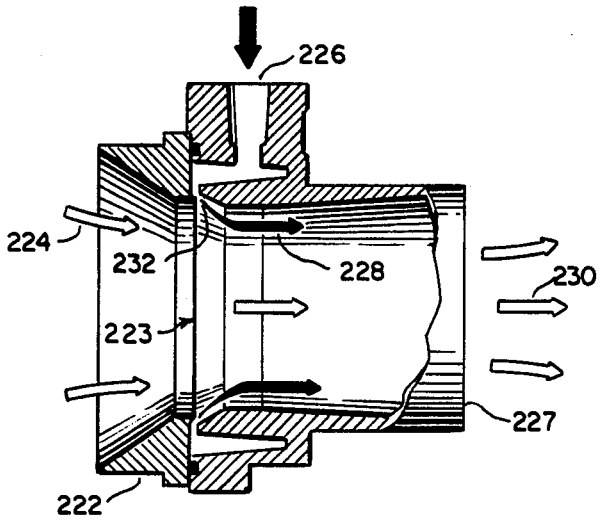
FIG. 2 is a cross-sectional view of component 22 from FIG. 1, here illustrated as component 222, showing the details of the liquid cryogen and warm refrigerating gas (return gas) mixer.

A critical portion of the implementation of the present invention is a high efficiency liquid cryogen-gas mixing means comprising in its preferred embodiment an ejector whereby a portion of the warm refrigerating gas or return gas passes through a large diameter central orifice in the ejector and is accelerated by impingement of liquid cryogen into the gas through an annular, slanted slot. This is shown in FIG. 2, whereby the ejector 222 has a relatively large diameter central orifice 223 wherein a portion of the warm refrigerating gas or return gas 224 is introduced and contacts liquid cryogen 228 emanating from a slanted annular slot 232 in the ejector 222. A liquid cryogen is introduced through a manifold 226 which feeds liquid cryogen to the ejector. The liquid cryogen, under elevated pressure, is forced through the narrow slit of the annular slot 232 at high speed, and becuase of the shape and direction or angle of attack of the slot, the liquid cryogen is directed at a high rate of speed to the outlet end 227 of the ejector 222. Many of the small particles of fast moving liquid cryogen contact the relatively slower moving particles of return gas (a portion of the warm refrigeration gas) causing the slow moving gas particles to speed up and the fast moving particles of liquid cryogen to slow down. Thus, the liquid cryogen is sacrificing velocity to induce a larger amount of return gas into a higher velocity than it previously existed in the streams from the surroundings. The capabilities of the ejector allow it to move a large volume of return gas for a relatively small amount of liquid cryogen and to move it at relatively high velocity. The interaction of the small amount of high speed liquid cryogen with the relatively larger volume and relatively slower moving gas provides high turbulence and extensive mixing, whereby the ratio of gas to liquid cryogen and the extent of mixing enhance and ensure the vaporization of all of the liquid cryogen. This capability is further accomplished by accurate control of downstream temperatures. The discharge gas 230 has been lowered in temperature by the vaporization of liquid cryogen, while at the same time warming the liquid cryogen sufficiently to essentially remove all liquid phase cryogen from the gas mixture. The discharge gas 230 (shown in FIG. 1 as flow 19) blends with the remaining warm refrigeration gas 20 to create a cold refrigerating gas 18.

The cryogen-gas mixer or ejector is the primary element in the present invention. It prevents the introduction of the liquid phase of the cryogen into the refrigerator or freezer compartment. The cryogen-gas mixer accomplishes this goal because it vaporizes the liquid cryogen as it is injected into the mixer or ejector and co-mingles with the portion of the warm refrigerating gas or return gas. When the liquid cryogen is injected, it entrains a portion of the warm refrigerating gas or return gas at a temperature of $T_1$, mixing thoroughly with said gas and discharges from the mixer or ejector as discharge gas 230 (FIG. 1, flow 19) at a much colder temperature of $T_2$. However, the much colder refrigerating gas or discharge gas is significantly warmer than the liquefaction temperature of the liquid cryogen being utilized. The very cold discharge gas at temperature $T_2$ discharging from the cryogen-gas mixer or ejector, enters the recirculating fan and is combined with the balance of the recirculating warm refrigerating gas whereby the temperature equilibrates and the gas becomes the cold refrigerating gas 18. The recirculating fan then moves the gas past the temperature probe where the temperature $T_3$ is sensed, and the gas continues toward contact with the product to be refrigerated or frozen. Responding to the temperature probe, the temperature controller cycles the on/off valve to maintain the required chamber temperature.

Since the kinetic energy of the fluids is negligible in the present invention, the following equation can be derived from the General Energy Equation:

$$m_1h_1+m_ch_c=(m_1+m_c)h_2 \qquad \text{[Equation 1]},$$

where;

$m_1$ = mass flow of return gas, lb/sec (kg/sec)

$h_1$ = enthalpy of return gas, Btu/lb (J/kg)

$m_c$=mass flow of cryogen (liquid), lb/sec (kg/sec)

$h_c$=enthalpy of cryogen (liquid), Btu/lb (J/kg)

$h_2$=enthalpy of discharge gas, Btu/lb (J/kg)

Solving this equation for the mass flow of return gas, $m_1$:

$$m_1 = \frac{(h_2 - h_c)}{(h_1 - h_2)} m_c \quad \text{[Equation 2]}$$

As a specific example, the following conditions could be established using liquified air (LAIR) as the refrigerant.

$$m_1 = \frac{(118.8 - 22.8)}{(159.8 - 118.8)} m_c$$

$$m_1 = 2.3\ m_c$$

Thus, the cryogen-gas mixer must entrain return gas at more than 2.3 times the amount of liquified air to assure that cold gaseous air enters the refrigeration or freezing system at the conditions specified and which are chosen to provide a comfortable margin above the liquefaction temperature of air.

EXAMPLE

Laboratory tests were conducted to evaluate a specific cryogen-air mixer. A Transvector Model 903 with 2 shims, #903 GASK, was mounted in a Cryo-Test Chamber Model CT-1818-12F. The Transvector was positioned 5 3/16" (132 mm) above the chamber floor. On the chamber floor an 11" diameter (279 mm) radial fan operated at 1725 rpm. Temperature measurements were taken with a Doric Trendicator 412A. The return gas temperature $T_1$ was measured 1⅛" (29 mm) above the Transvector inlet and the mixer discharge temperature $T_2$ was measured 1⅛" (29 mm) below the Transvector discharge. The controlled temperature $T_3$ was sensed with a Type T thermocouple positioned 11" (279 mm) above the chamber floor. A Thermo Electric temperature controller Model 80381-508-2 cycled a solenoid valve, Magnatrol Valve Corp. #10M42YZ, to admit the cryogen. The cryogen in the test was liquid nitrogen (LIN) stored at 26 psig. Additional tests were conducted to measure the LIN flow rate through the Transvector. The following is a list of typical data recorded during this period.

| Return gas $T_1$ | Discharge gas $T_2$ | Control Temp $T_3$ |
|---|---|---|
| −135° F. | −210° F. | −130° F. |
| −160° F. | −226° F. | −155° F. |

The LIN flowrate was measured to be 150 pounds LIN per hour.

When the test data is substituted in Equation 2 above, the following results are obtained.

LIN @ 26 psig, $h_c$ = 27.8 Btu/lb, saturated liquid $T_2$ = −210 degrees F, $h_2$ = 133.1 Btu/lb $T_1$ = −135 degrees F, $h_1$ = 151.7 Btu/lb $$m_1 = \frac{(133.1 - 27.8)}{(151.7 - 133.1)} m_c$$

$$m_1 = 5.66\ m_c$$

and:

-continued $T_2$ = −226 degrees F, $h_2$ = 128.9 Btu/lb $T_1$ = −160 degrees F, $h_1$ = 145.7 Btu/lb $$m_1 = \frac{(128.9 - 27.8)}{(145.7 - 128.9)} m_c$$

$$m_1 = 6.02\ m_c$$

In both of the above cases, the amount of return gas entrained is more than twice the minimum amount required to vaporize the cryogen, liquid nitrogen in this example. The minimum amount is 1.65 $m_c$ for return gas with a $T_1$ of −135° F. and is 1.89 $m_c$ for return gas with a $T_1$ of −160° F., based upon the liquefaction temperature of nitrogen of −320° F. and an $h_2$ of the discharge gas, wherein no liquid nitrogen exists, of 104.9 Btu/lb. Further, the discharge gas temperature ($T_2$) is significantly warmer than the liquefaction temperature of the cryogen; i.e., −320° F.

The present invention using a cryogen-gas mixer or ejector provides several advantages over the prior art of indirect heat exchange or mere dispersion of liquid cryogen into a recirculating fan. The system of the present invention is smaller and less expensive than heat exchangers and more efficient and dependable for full vaporization of liquid cryogen than the prior art of dispersion directly into the recirculating fan. The small size of the cryogen-gas mixer or ejector of the present invention permits the overall refrigeration or freezing to be more readily adapted to existing cryogenic refrigeration systems, such that it retrofits on a more acceptable and economically feasible basis. Further, conversion of a known cryogenic freezer equipped with recirculating fans to the mode of the present invention using a cryogen-gas mixer or ejector will require only a relatively small sized piece of apparatus to insure full vaporization of cryogen. This makes available the use of cryogen, such as liquid air. Such small size retrofit will also provide fewer problems in daily sanitation of equipment, particularly for that equipment utilized in food processing. To achieve greater refrigeration capacity, it is possible that one or more cryogen-gas mixers or ejectors can be directed into a single recirculation fan.

In addition, the process and apparatus of the present invention incorporating a cryogen-gas mixer or ejector will provide a cryogenic refrigeration or freezing system with a higher thermal efficiency than that of indirect heat exchange equipment. The discharged gas of an indirect heat exchanger must be colder than the chamber temperature for heat exchange to occur. By contrast, the use of the cryogen-gas mixer or ejector of the present invention permits the vaporized cryogen to leave the refrigeration or freezing system at the same temperature as exists in the chamber. Thus, more refrigeration will be made available for each unit of cryogen injected into this system operated by the techniques of the present invention.

The present invention has been set forth with regard to one specific embodiment, but the scope of the invention should be ascertained from the claims which follow.

I claim:

1. The method of refrigerating products by contact with a refrigerating gas which comprises introducing product into a refrigeration zone, contacting the product with the refrigerating gas for a sufficient time to refrigerate it to the appropriate extent and removing the refrigerated product, the improvement for producing the refrigerating gas from a liquid cryogen such that essentially all of the liquid cryogen is fully vaporized before contacting the product comprising;

(a) introducing the liquid cryogen, selected from the group consisting of liquid air and liquid nitrogen, at elevated pressure into an ejector as the motive fluid to accelerate a portion of a warm refrigerating gas through the ejector while mixing the cryogen and gas to effect complete vaporization of the liquid cryogen and substantial cooling of said portion of the refrigerating gas resulting in a cold discharge gas which is above the liquefaction temperature of the cryogen;

(b) introducing the cold discharge gas into a forced circulation pathway of refrigerating gas and producing a cold refrigerating gas which contacts and refrigerates product and is then at least partially recirculated;

(c) sensing the temperature of the refrigerating gas in the forced circulation pathway and controlling the introduction of liquid cryogen with regard to the sensed temperature to maintain the temperature of the discharge gas above the liquefaction temperature of the cryogen utilized.

2. The process of claim 1 wherein the temperature of the cold discharge gas is at least 50° F. above the liquefaction temperature of the cryogen.

3. The process of claim 1 wherein the liquid cryogen passes through an annular slot in the ejector to accelerate said portion of the warm refrigeration gas.

4. The process of claim 1 wherein the liquid cryogen is vaporized in the ejector upon mixing with said portion of the warm refrigerating gas.

5. The process of claim 1 wherein the cold refrigerating gas is at a sufficiently low temperature so as to freeze the product.

6. The method of refrigerating products by contact with a refrigerating gas which comprises introducing product into a refrigeration zoned, contacting the product with the refrigerating gas for a sufficient time to refrigerate it to the appropriate extent and removing the refrigerated product, the improvement for producing the refrigerating gas from a liquid cryogen such that essentially all of the liquid cryogen is fully vaporized before contacting the product comprising;

(a) introducing the liquid cryogen, selected from the group consisting of liquid air and liquid nitrogen, at elevated pressure into an ejector as the motive fluid to accelerate a portion of a warm refrigerating gas through the ejector while mixing the cryogen and gas to effect complete vaporization of the liquid cryogen and substantial cooling of said portion of the refrigerating gas resulting in a cold discharge gas which is above the liquefaction temperature of the cryogen, whereby the flow of said portion of the warm refrigerating gas to the flow of liquid cryogen is controlled to satisfy the following relationship:

$$m_1 = \frac{(h_2 - h_c)}{(h_1 - h_2)} m_c$$

where the variables have the following values:

$m_1$=mass flow of return gas, lb/sec (kg/sec)
$h_1$=enthalpy of return gas, Btu/kb (J/kg)
$m_c$=mass flow of cryogen (liquid), lb/sec (kg/sec)
$h_c$=enthalpy of cryogen (liquid), Btu/lb (J/kg)
$h_2$=enthalpy of discharge gas, Btu/lb (J/kg);

(b) introducing the cold discharge gas into a forced circulation pathway of refrigerating gas and producing a cold refrigerating gas which contacts and refrigerates product and is then at least partially recirculated;

(c) sensing the temperature of the refrigerating gas in the forced circulation pathway and controlling the introduction of liquid cryogen with regard to the sensed temperature to maintain the temperature of the discharge gas above the liquefaction temperature of the cryogen utilized.

* * * * *